US005331706A

United States Patent [19]

Graham

[11] Patent Number: 5,331,706

[45] Date of Patent: Jul. 26, 1994

[54] WRINGER-TYPE SPONGE MOP AND SPONGE CLAMP THEREFOR

[75] Inventor: John W. Graham, Greenville, S.C.

[73] Assignee: Southern Technologies, Inc., Greenville, S.C.

[21] Appl. No.: 66,566

[22] Filed: May 26, 1993

[51] Int. Cl.[5] ..... A47L 13/24

[52] U.S. Cl. ..... 15/119.2

[58] Field of Search ..... 15/116.2, 119.2; 403/375, 383, 386, 388

[56] References Cited

U.S. PATENT DOCUMENTS

| | | | |
|---|---|---|---|
| 2,080,361 | 5/1937 | Lindstrom | 403/383 |
| 2,864,107 | 12/1958 | Greenleaf . | |
| 3,289,233 | 12/1966 | Smyth et al. . | |
| 3,345,667 | 10/1967 | Blum | 15/119.2 |
| 3,727,259 | 4/1973 | Wilson . | |
| 4,196,488 | 4/1980 | Barry | 15/119.2 |
| 4,439,885 | 4/1984 | Klotz . | |
| 4,481,688 | 11/1984 | Graham . | |
| 4,491,998 | 1/1985 | Wilson et al. . | |
| 4,516,287 | 5/1985 | Johnson et al. . | |
| 4,654,920 | 4/1987 | O'Neil, Jr. et al. . | |
| 4,706,323 | 11/1987 | Batchelor . | |
| 4,834,573 | 5/1989 | Asano | 403/383 |
| 4,862,550 | 9/1989 | Batchelor . | |
| 4,895,368 | 1/1990 | Geiger | 403/383 |
| 4,908,901 | 3/1990 | Torres . | |
| 5,097,561 | 3/1992 | Torres . | |

FOREIGN PATENT DOCUMENTS

| | | | |
|---|---|---|---|
| 1341967 | 9/1963 | France | 403/383 |
| 546167 | 7/1956 | Italy | 15/119.2 |
| 2200537 | 8/1988 | United Kingdom | 15/119.2 |

*Primary Examiner*—Philip R. Coe
*Assistant Examiner*—Terrence R. Till
*Attorney, Agent, or Firm*—Bell, Seltzer, Park & Gibson

[57] ABSTRACT

A cleaning sponge connection for a wringer type sponge mop is disclosed. A latch hook at a lower end of an operating rod has a free end portion of a predetermined length and a non-circular cross-sectional shape. An elongate sponge clamp includes an elongate upper wall and a pair of opposing side walls which retain a sponge. The sponge clamp has at least one arch integrally formed in the elongate upper wall thereby defining a latch passageway extending longitudinally along the elongate upper wall. The latch passageway receives the free end portion of the latch hook to removably secure the sponge clamp to the operating rod. The latch passageway has a non-circular cross-sectional opening corresponding to the non-circular cross-sectional shape of the free end portion of the latch hook for preventing rotational movement of the sponge clamp about the latch hook. In addition, the upper wall of the sponge clamp has a recess that is at least as long as the predetermined length of the free end portion of the latch hook extending longitudinally along the upper wall of the sponge clamp to define a guide channel for receiving the latch hook. The guide channel is aligned with and adjacent to the latch passageway for guiding the free end portion of the latch hook into the latch passageway. The guide channel preferably extends the full length of the sponge clamp.

13 Claims, 1 Drawing Sheet 11
10
17
18
16
12
12a
12b
15
13
14
24

28
27
30

36
34
27
28
33
35

21
35
34
22

6
33
34

20
21
27
22
31
36
32
26
28
33

WRINGER-TYPE SPONGE MOP AND SPONGE CLAMP THEREFOR

FIELD OF THE INVENTION

This invention relates generally to wringer type sponge mops, and more particularly, to a cleaning sponge connection that may be quickly and easily operated to disconnect or connect a cleaning sponge from a sponge mop's operating rod.

BACKGROUND OF THE INVENTION

Wringer mops with replaceable cleaning sponges are well known and usually require the removal and replacement of a threaded bolt and nut to remove and replace the cleaning sponge. The removal and replacement of the threaded bolt and nut usually requires the use of hand tools which may not be readily available and which are not easily operable in the typical confined space available for positioning. Also, the nut and screw arrangement may become rusted or corroded with use and may be difficult to remove and replace.

U.S. Pat. No. 4,481,688 discloses a cleaning sponge connection that does not require bolts or screws. Essentially, an operating rod's latch hook is wedged into a sponge clamp's arcuate latch hook tunnel thereby holding the sponge clamp between a pair of opposing rollers. This design, however, suffers from three distinct disadvantages. First, changing the angular position of the cleaning sponge is awkward and difficult. The user must free the latch hook from its wedged position in the sponge clamp by forcing down one side of the sponge clamp, while keeping the rollers apart, and with enough longitudinal force to liberate the wedged latch hook. Second, the sponge mop relies on the rollers themselves to inhibit rotational movement of the cleaning sponge about the latch hook while in operation. This stress on the rollers has a deleterious effect on the rollers yieldable clamping, resulting in less force when squeezing water from the cleaning sponge. Third, the provided guide channel does not keep the sponge clamp properly oriented to the operating rod, the rollers, and the rest of the mop assembly, when removing or replacing the cleaning sponge.

Other prior art devices also present difficulties when removing and replacing the cleaning sponge. One known method of guiding a latch hook into position is to form an angled recess in the sponge clamp. One such prior art device, disclosed in U.S. Pat. No. 4,862,550, uses an offset downwardly sloped recess in combination with a raised tab in a sponge clamp's latch hook tunnel to guide the sponge mop's latch hook into the sponge clamp. The latch hook is then pivoted into alignment with the longitudinal center line of the retaining latch hook tunnel. Initial and final alignment, however, rely on the installer's ability to orchestrate the operating rod, the sponge clamp, and the opposing rollers in parallel and angled positions in tight spaces. In addition, this sponge clamp relies on the opposing rollers to inhibit rotational movement about the latch hook.

Still other prior art devices are designed as multipurpose replacement sponge assemblies for mops. U.S. Pat. No. 4,908,901, for example, is designed for use with a variety of different mops. A first connection is provided by a threaded screw at the top of a latch hook tunnel so that an operating rod can be threaded therethrough. Although a threaded screw attachment does inhibit rotational movement, the threads may be stripped or otherwise corroded. A second connection means is provided by two raised tabs, each of which receive a spaced apart L-shaped connecting element. Both the tabs and the L-shaped connecting elements suffer from a necessarily light construction to facilitate their placement. This designed flexibility lends itself to fatigue, brittleness, and failure. A third connection means accepts an operating rod's latch hook. The attachment means for a latch hook, however, fails to inhibit rotational movement about the latch hook and does not provide an orienting guide means.

SUMMARY OF THE INVENTION

With the foregoing in mind, it is an object of the present invention to provide a cleaning sponge connection for a wringer type sponge mop which may be quickly and easily operated to replace the cleaning sponge.

It is yet another object of the present invention to prevent rotational movement of the cleaning sponge clamp about an operating rod's latch hook.

These and other objects according to the present invention are provided by a wringer type sponge mop which includes an elongate handle and a pair of opposing rollers carried at one end of the elongate handle. An operating rod extends along the elongate handle and includes a latch hook at a lower end with a free end portion of a predetermined length and a non-circular cross-sectional shape. An elongate sponge clamp, including an elongate upper wall and a pair of opposing side walls integrally formed with the elongate upper wall and depending therefrom along opposite sides of the elongate upper wall retains the cleaning sponge. The sponge clamp has at least one arch integrally formed in the elongate upper wall so as to define a latch passageway extending longitudinally along the elongate upper wall for receiving the free end portion of the latch hook to thereby removably secure the sponge clamp to the operating rod. The latch passageway has an opening of a non-circular cross-sectional shape corresponding to the non-circular cross-sectional shape of the free end portion of the latch hook for receiving the free end portion and preventing rotational movement of the sponge clamp about the latch hook.

The elongate upper wall of the sponge clamp has a recess that is at least as long as the predetermined length of the free end portion of the latch hook extending lengthwise so as to define a guide channel for receiving the free end portion of the latch hook. The guide channel is located adjacent to the latch passageway and in alignment therewith for guiding the free end portion of the latch hook into the latch passageway. Preferably, the guide channel extends the full length of the elongate upper wall. Finally, an operating lever, which can move the sponge clamp and its retained cleaning sponge to three positions, is connected to an upper end of the operating rod. A first or innermost position places the cleaning sponge between the opposing rollers so that any liquid is squeezed therefrom. A second position fixes the opposing sidewalls of the sponge clamp between the opposing rollers in a cleaning position. A third or outermost position shifts the sponge clamp beyond the squeezing rollers to a position which facilitates the removal or replacement of the cleaning sponge.

In one embodiment, the free end portion of the latch hook incorporates an elongate body with at least one protruding flange. Preferably, there are a plurality of opposing flanges extending from opposite sides of the latch book's linear body so as to define the non-circular cross-sectional shape as a generally circular cross-sectional core with a pair of opposing protrusions extending outwardly therefrom.

In addition, the sponge clamp preferably includes a second arch integrally formed in the sponge clamp's elongate upper wall defining a second latch passageway extending longitudinally along the elongate upper wall. A segmental portion of the elongate upper wall, which separates the two latch passageways, has a recess therein corresponding to and in longitudinal alignment with the guide channel.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figures 1, 2, 3, 4, 5, 6:
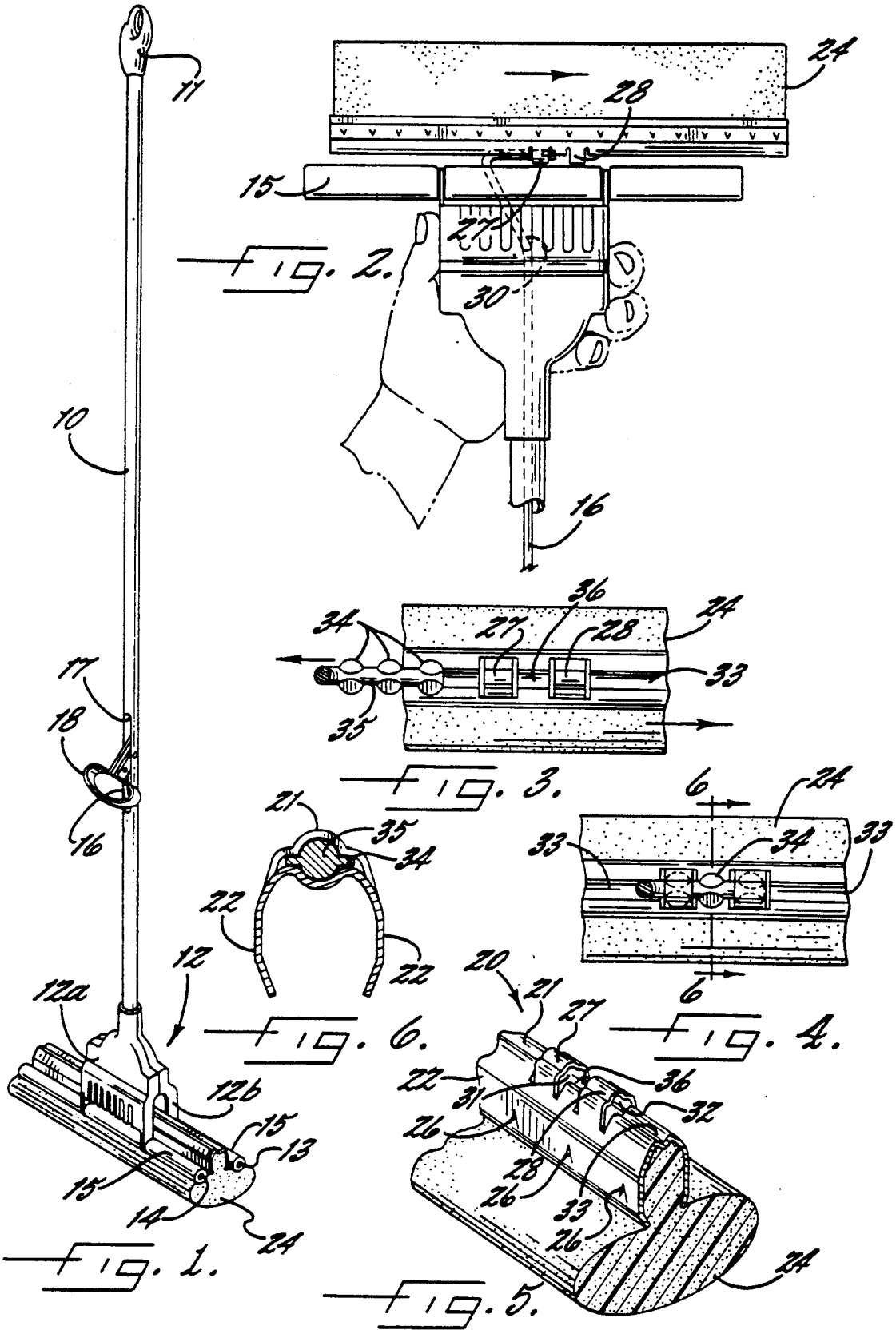
FIG. 1 is a perspective view of a wringer type sponge mop with a cleaning sponge connection of the present invention associated therewith.
FIG. 2 is an elevational view of a lower end of the mop shown in FIG. 1 and illustrates the sponge clamp shifted beyond the squeezing rollers to facilitate the removal and replacement thereof.
FIG. 3 is a fragmentary longitudinally extending vertical sectional view through the central portion of FIG. 2 and illustrates the manner in which a latch hook is moved to an unlatched position for removal and replacement of a cleaning sponge.
FIG. 4 is a view similar to FIG. 3 but showing a latch hook in position after a cleaning sponge has been replaced.
FIG. 5 is a fragmentary isometric view of a central portion of a cleaning sponge and illustrates a guide channel and two latch passageways formed in an elongate upper wall of a sponge clamp.
FIG. 6 is a cross-sectional view along the line 6—6 of FIG. 4 and illustrates a non-circular cross-sectional shape of a free end portion of a latch hook and a corresponding cross-sectional opening in a latch passageway.

The present invention will now be described more fully hereinafter with reference to the accompanying drawings in which a preferred embodiment of the invention is shown. This invention may, however, be embodied in different forms and should not be construed as limited to the embodiments set forth herein; rather this embodiment is provided so that this disclosure will be thorough and complete, and will fully convey the scope of the invention to those skilled in the art.

A wringer mop, as shown in FIG. 1, generally includes an elongate handle, in the form of a hollow tube 10, with a suitable closure element 11 fixed at one end, which may include an opening for hanging the mop on a nail or a hook. A cleaning head support housing, broadly indicated at 12, is fixed on the other end of the handle 10 and may be formed in two halves of stamped sheet metal. The housing 12 has the general shape of a hollow bell and has generally flat front and rear side walls 12*a* and end walls 12*b*. The end walls 12*b* are bifurcated to provide support legs for a pair of roller support shafts 13, 14 on which a pair of opposing rollers 15 are supported. The opposing rollers 15 define an elongate passageway between them.

An operating rod 16 with a generally circular cross section extends upwardly through the handle 10 and has an upper end bent outwardly at an angle through a slot 17 along a medial portion of the handle 10. An operating lever 18 is pivotally connected at its inner end to the handle 10. The upper end of the operating rod 16 is pivotally connected to a medial portion of the operating lever 18. The operating lever 18 can impart longitudinal inward and outward movement to the operating rod 16. Thus, the position of a cleaning sponge 24 is controlled by the movement of the operating lever 18. When the operating lever 18 is moved upwardly from the position shown in FIG. 1, the cleaning sponge 24 is drawn inwardly between the opposing rollers 15 so that any liquid in the cleaning sponge 24 is squeezed therefrom. When the operating lever 18 is moved back to the position shown in FIG. 1, the cleaning sponge 24 is moved outwardly between the pair of opposing rollers 15 to the cleaning position shown in FIG. 1. When the operating rod 18 is moved downwardly from the position shown in FIG. 1, the sponge clamp 20 and the cleaning sponge 24 are moved beyond the opposing rollers 15 to a position which facilitates the removal or replacement of the cleaning sponge 24, as shown in FIG. 2.

A latch hook 30 is integrally formed at one end of the operating rod 16 and extends parallel to the pair of opposing rollers 15 and an elongate upper wall 21 of the sponge clamp 20. The inner end of the latch hook 30, which is integral with the operating rod 16, is formed by bending the operating rod 16 at an acute angle and then at slightly greater than a right angle so that the latch hook 30 extends perpendicular to the operating rod 16. A free end portion 35 of the latch hook 30 thus forms a part of a connecting means for selectively connecting and disconnecting the sponge clamp 20 with the lower end of the operating rod 16. The latch hook 30 includes an elongate body with at least one protruding flange. Preferably, there are multiple opposing flanges 34 stamped in the free end portion 35 of the latch hook 30 to define a predetermined non-circular cross-sectional shape that has a generally circular care with a pair of outwardly extending opposing protrusions, as shown in FIG. 6. The opposing flanges 34 not only provide aid in orienting the sponge clamp 20 prior to insertion of the latch hook 30, but also stabilize the sponge clamp 20 by inhibiting any rotation about the latch hook after insertion.

A sheet metal sponge clamp, broadly indicated in FIG. 5 at 20, is provided with an elongate upper wall 21 and opposing side walls 22 which are normally positioned between the set of opposing rollers 15. The upper portion of the cleaning sponge 24 is fixed in the sponge clamp 20 and held between the side walls 22 by inwardly bent gripping fingers 26 (FIG. 5). When in the normal cleaning position, the lower portion of the cleaning sponge 24 extends outwardly beyond the opposing rollers 15 while the side walls 22 of the sponge clamp 20 are positioned between the opposing rollers 15, as illustrated in FIG. 1. The sponge clamp 20 also includes at least one arch 27 integrally formed in the elongate upper wall 21 extending longitudinally along the elongate upper wall 21 to define a latch passageway 31.

The illustrated embodiment also uses a second arch 28 formed in the elongate upper wall 21 to define a second longitudinally extending latch passageway 32. The first and second latch passageways 31, 32 form openings which correspond in shape to the predetermined non-circular cross-sectional shape of the free end portion 35 of the latch hook 30. As shown in FIG. 5, a segmental portion 36 separates the first and second latch passageways 31, 32. Thus, the latch passageways 31, 32 work in conjunction with the segmental portion 36 to removably engage the free end portion 35 of the latch hook 30. In addition, even though prior art latch hooks are designed for their associated prior art sponge clamps, the sponge clamp 20 of the present invention will accept most latch hooks which have a generally circular cross-sectional shape, such as those illustrated in U.S. Pat. Nos. 4,481,688, 4,706,323, and 4,862,550.

A recess formed in the upper wall 21 of the sponge clamp 20 extends lengthwise along the sponge clamp 20 and defines a guide channel 33 adjacent and between the latch passageways 31, 32 for guiding the free end portion 35 of the latch hook 30 therein. The guide channel 33 is preferably formed in the elongate upper wall 21 of the sponge clamp 20 in longitudinal alignment with and at opposite ends of the latch passageways 31, 32. The guide channel 33 extends outwardly from the latch passageways 31, 32 a distance which is at least as long as the predetermined length of the free end portion 35 of the latch hook 30. Thus, the free end portion 35 of the latch hook 30 can be placed in and oriented by the guide channel 33 prior to insertion in the latch passageways 31, 32. The guide channel 33 preferably extends the length of the sponge clamp 20 to also provide reinforcing structural support. The depth of the guide channel 33 is approximately one half the diameter of the latch hook 30. The latch passageways 31, 32 extend above the elongate upper wall 21 a distance of about one half the diameter of the latch hook 30 so that the free end portion 35 of the latch hook 30 will pass through the latch passageways 31, 32.

In order to remove and replace the cleaning sponge 24, the operating lever 18 is moved downwardly from the position shown in FIG. 1 to shift the sponge clamp 20 to an outer position beyond the pair of opposing rollers 15, as shown in FIG. 2. The cleaning sponge 24 may then be moved longitudinally in the direction of the free end portion 35 of the latch hook 30 and thus easily removed from the latch passageways 31, 32. To connect a new cleaning sponge 24, the free end portion 35 of the latch hook 30 is first positioned in a guide channel 33 of a replacement sponge clamp 20. The sponge clamp 20 is then moved longitudinally toward the operating rod 16 while keeping the flanges 34 positioned on the guide channel 33 so that the latch passageways 31, 32 of the sponge clamp 20 can receive the free end portion 35 of the latch hook 30. The opposing flanges 34 properly align the sponge clamp 20 as they slide longitudinally into the latch passageways 31, 32. When the connection of the new cleaning sponge 24 to the latch hook 30 is completed, as illustrated in FIG. 4, the operating lever 18 is moved upwardly and returns to the cleaning position shown in FIG. 1. By preventing rotational movement, the opposing flanges 34 ensure that the sponge clamp 20 and latch hook 30 are properly oriented when moving the operating lever 18 from the outer position back to the cleaning position.

With the free end portion 35 of the latch hook 30 positioned within the latch passageways 31, 32 as illustrated in FIG. 4, the opposing flanges 34 prevent rotation of the sponge clamp 20 about the latch hook 30. The snugly fitted opposing flanges 34 retained in the latch passageways 31, 32 result in a sponge clamp connection that is firm and stable and ensures that the sponge clamp 20 and latch hook 30 are properly oriented when moving the operating rod 18 from the replacement position to the cleaning position. Normal use of the inventive sponge mop does not impart enough longitudinal force to dislodge the latch hook 30 from the sponge clamp 20. Therefore, a mop incorporating the present invention may be used in a customary manner with all the above advantages.

The cleaning sponge connection of the present invention thus requires no bolts and nuts or other extraneous connection means but is simply and easily connected to and disconnected from the lower end of the operating rod 16 by simple manipulation of the operating lever 18, the sponge clamp 20, and the free end portion 35 of the latch hook 30. Since both ends of the latch passageways 31, 32 are formed in the same manner and identical guide channels 33 are provided at opposite ends thereof, either end of the sponge clamp 20 may be easily connected to the free end portion 35 of the latch hook 30.

One skilled in the art would readily appreciate that other forms of the invention can be incorporated into wringer type sponge mops. Accordingly, many modifications and other embodiments of the invention will come to the mind of one skilled in the art having the benefit of the teachings presented in the foregoing descriptions and the associated drawings. The drawings and specification set forth the best mode presently contemplated for the practice of the present invention, and although specific terms are employed, they are used in a generic and descriptive sense only and not for purposes of limitation. Therefore, it is to be understood that the invention is not to be limited to the particular embodiment disclosed, and that modifications and other embodiments are intended to be included within the scope of the appended claims.

That which is claimed is:

1. A wringer type sponge mop comprising:

an elongate handle;

a pair of opposing rollers carried at one end of said elongate handle;

an operating rod having a lower end including a latch hook, said latch hook having a free end portion of a predetermined length defining a longitudinal axis and a non-circular cross-sectional shape in a cross-section taken orthogonally to said longitudinal axis;

a sponge clamp positioned between said rollers, said sponge clamp including an elongate upper wall, a pair of side walls integrally formed with said upper wall and depending therefrom along opposite sides of said elongate upper wall, an arch integrally formed in said upper wall and defining a latch passageway extending longitudinally along said elongate upper wall for receiving the free end portion of said latch hook therein to removably secure said sponge clamp to said operating rod, said latch passageway having a non-circular cross-sectional shape corresponding to the non-circular cross-sectional shape of the free end portion of said latch hook for receiving said free end portion and preventing rotational movement of the sponge clamp about the latch hook, a recess formed in said upper wall adjacent said latch passageway and in longitudinal alignment therewith, said recess having a length at least as long as the predetermined length of the free end portion of said latch hook and defining a guide channel for receiving the free end portion of said latch hook and guiding same into said latch passageway;

a sponge secured to said sponge clamp; and an operating lever connected to an upper end of said operating rod, said operating lever being movable to squeeze said sponge between said opposing rollers.

2. The mop of claim 1 wherein said guide channel extends a full longitudinal length of said elongate upper wall.

3. The mop of claim 1 wherein the non-circular cross-sectional shape is a generally circular core with a pair of opposing protrusions extending outwardly therefrom.

4. The mop of claim 1 further comprising a second arch integrally formed in said elongate upper wall in spaced apart relation from said first arch, said second arch defining a second latch passageway in longitudinal alignment with said first latch passageway, said second latch passageway having a non-circular cross-sectional shape corresponding to the non-circular cross-sectional shape of the free end portion of said latch hook for receiving said free end portion and preventing rotational movement of the sponge clamp about the latch hook.

5. The mop of claim 4 wherein a portion of said elongate upper wall between the two spaced apart arches has a recess therein corresponding to and in longitudinal alignment with said guide channel.

6. A wringer type sponge mop comprising:

an elongate handle;

a pair of opposing rollers carried at one end of said elongate handle;

an operating rod having a lower end including a latch hook, said latch hook having a free end portion of a predetermined length defining a longitudinal axis and a non-circular cross-sectional shape in a cross-section taken orthogonally to said longitudinal axis;

an elongate sponge clamp positioned between said rollers, said sponge clamp including an elongate upper wall, a pair of opposing side walls integrally formed with said upper wall and depending therefrom along opposite sides of the elongate upper wall, an arch integrally formed in said elongate upper wall so as to define a latch passageway extending longitudinally along said elongate upper wall to removably secure said sponge clamp to said operating rod, said latch passageway having a non-circular cross-sectional shape corresponding to the non-circular cross-sectional shape of the free end portion of said latch hook for receiving the free end portion and preventing rotational movement of the sponge clamp about the latch hook; and a sponge secured to said sponge clamp; and an operating lever connected to an upper end of said operating rod, said operating lever being movable to squeeze said sponge between said opposing rollers and to move said sponge to a cleaning position.

7. The mop of claim 6 wherein the free end portion of said latch hook includes an elongate body and a plurality of flanges extending from opposite sides thereof and defining said non-circular cross-sectional shape as a generally circular core with a pair of opposing protrusions extending outwardly therefrom.

8. The mop of claim 7 further comprising a second arch integrally formed in said upper wall, said second arch defining a second latch passageway extending longitudinally along said elongate upper wall, said second latch passageway having a non-circular cross-sectional shape corresponding to the non-circular cross-sectional shape of the free end portion of said latch hook for receiving said free end portion and preventing rotational movement of the sponge clamp about the latch hook.

9. A sponge clamp for use in a sponge mop of the type which includes a wringer comprising a pair of opposing rollers which are actuable by an operating rod, the operating rod including a latch hook at a lower end thereof for engaging the sponge clamp, the latch hook having a free end portion of a predetermined length defining a longitudinal axis and a non-circular cross-sectional shape in a cross-section taken orthogonally to said longitudinal axis, said sponge clamp comprising:

an elongate upper wall;

a pair of side walls integrally formed with said upper wall and depending therefrom along opposite sides of the elongate upper wall;

a sponge secured between said pair of opposing side walls;

an arch integrally formed in said upper wall and defining a latch passageway extending longitudinally along said elongate upper wall adapted for receiving the free end portion of the latch hook therein to removably secure said sponge clamp to the operating rod, said latch passageway having a non-circular cross-sectional shape corresponding to the non-circular cross-sectional shape of the free end portion of the latch hook for receiving said free end portion and for preventing rotational movement of the sponge clamp about the latch hook; and a recess formed in said upper wall adjacent said latch passageway and in longitudinal alignment therewith, said recess having a length at least as long as the predetermined length of the free end portion of the latch hook and defining a guide channel for receiving the free end portion of the latch hook and guiding same into said latch passageway.

10. The sponge clamp of claim 9, wherein said guide channel extends a full longitudinal length of said elongate upper wall.

11. The sponge clamp of claim 10 further comprising a second arch integrally formed in said upper wall, said second arch defining a second latch passageway extending longitudinally along said elongate upper wall, said second latch passageway having a non-circular cross-sectional shape corresponding to the non-circular cross-sectional shape of the free end portion of the latch hook for receiving said free end portion and preventing rotational movement of the sponge clamp about the latch hook, and wherein a portion of said elongate upper wall between the two spaced apart arches has a recess therein corresponding to and in longitudinal alignment with said guide channel.

12. A sponge clamp for use in a sponge mop of the type which includes a wringer comprising a pair of opposing rollers which are actuable by an operating rod, the operating rod including a latch hook at a lower end thereof for engaging the sponge clamp, the latch hook having a free end portion of a predetermined length defining a longitudinal axis and a non-circular cross-sectional shape in a cross-section taken orthogonally to said longitudinal axis, said sponge clamp comprising:

an elongate upper wall;

a pair of opposing side walls integrally formed with said elongate upper wall and depending therefrom along opposite sides of said elongate upper wall;

a sponge secured between said pair of opposing side walls; and an arch integrally formed in said upper wall and defining a latch passageway extending longitudinally along said elongate upper wall for receiving the free end portion of the latch hook therein to removably secure said sponge clamp to the operating rod, said arch including an opening corresponding to a non-circular cross-sectional shape for preventing rotational movement of the sponge clamp about the latch hook.

13. The sponge clamp according to claim 12 wherein the non-circular cross-sectional shape is a generally circular core with a pair of opposing protrusions extending outwardly therefrom.

* * * * *